United States Patent [19]

Holladay

[11] Patent Number: 4,792,043

[45] Date of Patent: Dec. 20, 1988

[54] SHIPPING UNIT FOR NON-RIDING LAWN MOWER OR THE LIKE

[75] Inventor: John T. Holladay, Pinson, Tenn.

[73] Assignee: Packaging Corporation of America, Evanston, Ill.

[21] Appl. No.: 150,997

[22] Filed: Feb. 1, 1988

[51] Int. Cl.[4] ..... B65D 81/16

[52] U.S. Cl. ..... 206/349; 206/335; 206/587; 206/594

[58] Field of Search ..... 206/45.14, 319, 320, 206/349, 335, 587, 588, 591–594

[56] References Cited

U.S. PATENT DOCUMENTS

| | | | |
|---|---|---|---|
| 1,728,894 | 9/1929 | Oppenheim | 206/594 |
| 2,355,804 | 8/1944 | Hutchinson | 206/594 |
| 2,932,438 | 4/1960 | Smith | 206/320 |
| 3,015,428 | 1/1962 | Magazzu | 206/592 |
| 3,192,680 | 7/1965 | Mantell et al. | 206/592 |
| 3,481,453 | 12/1969 | Shreve, III et al. | 206/45.14 |
| 3,580,467 | 5/1971 | Pieszak | 206/319 |
| 4,008,847 | 2/1977 | Davis | 206/335 |
| 4,171,741 | 10/1979 | Fish | 206/335 |
| 4,595,097 | 6/1986 | Herstein | 206/335 |

*Primary Examiner*—Jimmy G. Foster

*Attorney, Agent, or Firm*—Neuman, Williams, Anderson & Olson

[57] ABSTRACT

A shipping unit is provided for accommodating a relatively heavy product such as a non-riding mower with a handle therefor in a collapsed mode. The unit includes an outer container of corrugated fibreboard material in which the mower is disposed. The outer container includes a bottom section subtending the accommodated mower; side sections extending upright from the periphery of the bottom section and substantially embracing the accommodated mower; and closure members disposed at upper portions of the side sections and overlying the accommodated mower. Disposed within the container and supportingly engaged by the container bottom section is a base pad. The pad has a surface thereof provided with a plurality of relatively spaced wheel wells in which the wheels of the accommodated mower are disposed. Also positioned within the outer container is an inner packing of unitary construction for stabilizing the accommodated mower. The inner packing includes a central segment in spaced overlying relation with the base pad, and opposed upright side segments extending from the base pad to the container closure members. Each side segment includes a first portion foldably connected to the central segment and spaced from an adjacent container side section. Foldably connected to the first portion are opposed second portions. Each second portion spans the distance between the first portion and the adjacent container side section.

7 Claims, 1 Drawing Sheet

FIG. 1
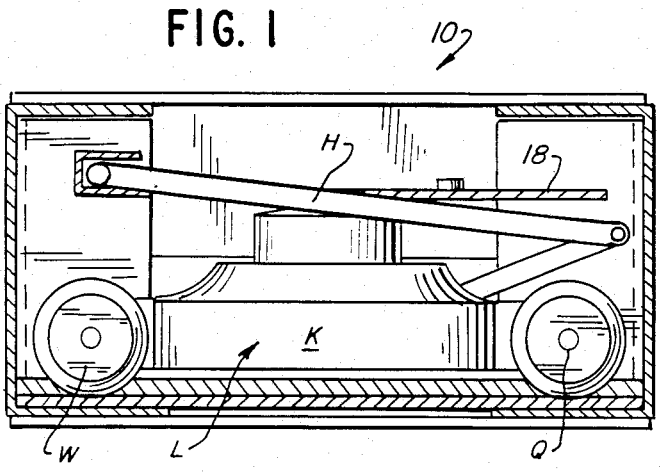
FIG. 5
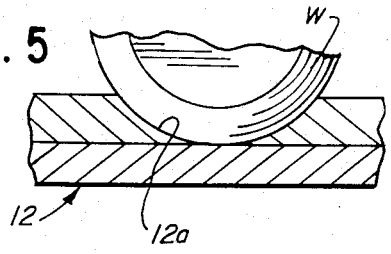
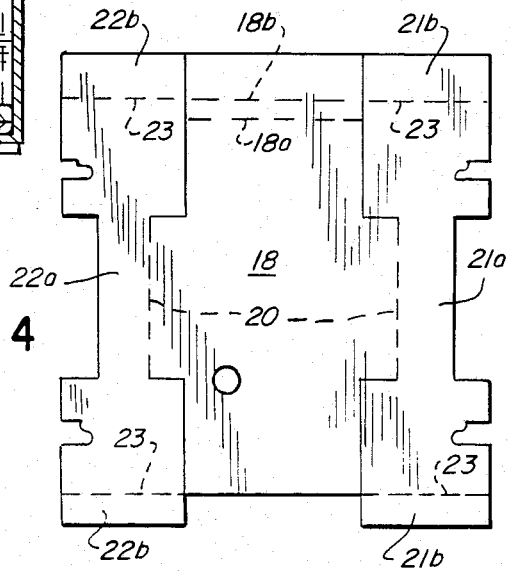
FIG. 4
FIG. 2
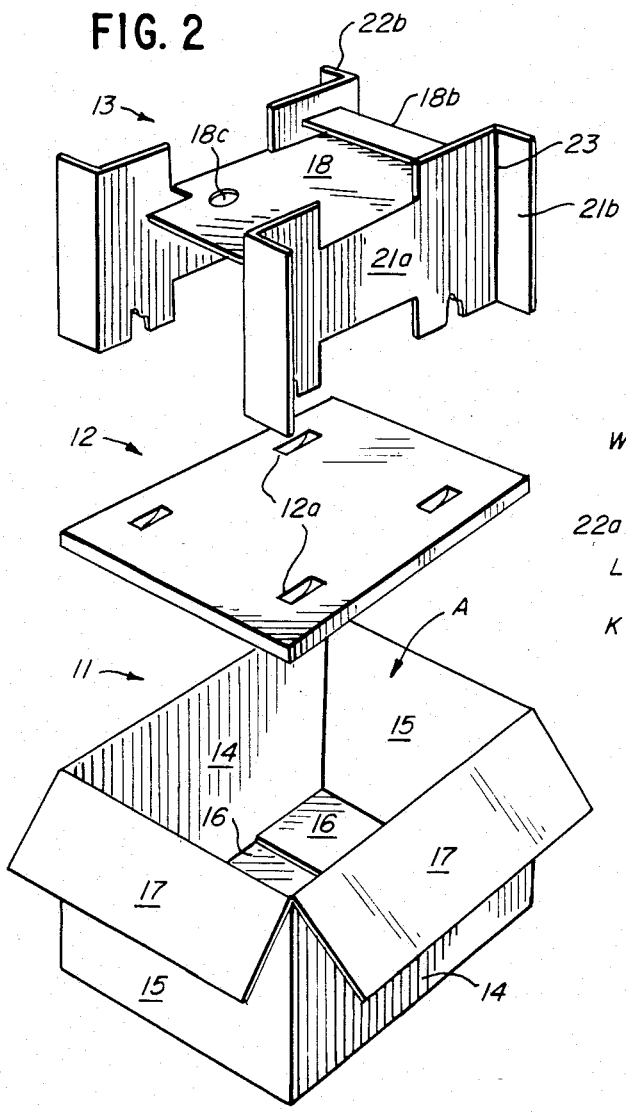
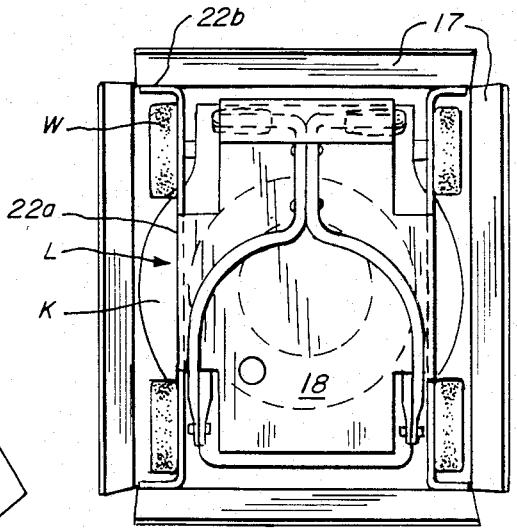
FIG. 3

SHIPPING UNIT FOR NON-RIDING LAWN MOWER OR THE LIKE

BACKGROUND OF THE INVENTION

The packing or crating of products, such as non-riding lawn mowers and the like, has in the past been an awkward, time-consuming, labor intensive operation. Prior shipping units of this general type were beset with one or more of the following shortcomings: (a) the unit embodied an inordinate number of components; (b) the unit provided ineffective protection for the accommodated product; (c) the unit was incapable of effectively supporting a plurality of like units when arranged in stacked relation; and d) the components comprising the unit were of costly, bulky and complex construction.

SUMMARY OF THE INVENTION

Thus, it is an object of the invention to provide an improved shipping unit which avoids all of the aforenoted shortcomings.

It is a further object to provide an improved shipping unit which is capable of accommodating variety of products.

It is a still further object to provide an improved shipping unit which incorporates a minimal number of components which are of simple, inexpensive design and may be expeditiously assembled in a facile manner and with a minimal amount of manual effort.

Further and additional objects will appear from the description, accompanying drawings and appended claims.

In accordance with one embodiment of the invention, an improved shipping unit is provided which is particularly suitable for accommodating a non-riding lawn mower having a handle therefore in a collapsed mode. The unit includes an outer container formed from a blank of corrugated fibreboard material. The container is provided with a bottom section which subtends the accommodated mower, and side sections which extend upwardly from the periphery of the bottom section and embrace the accommodated mower. Closure means are provided on the upper portions of the side sections and are adapted to overlie the accommodated mower. Disposed within the container and supported by the bottom section thereof is a base pad which supportingly engages the underside of the accommodated mower. The surface of the base pad adjacent the mower underside is provided with a plurality of relatively spaced wheel wells or pockets, each of which is adapted to partially accommodate a wheel of the mower. The base pad and the container bottom section are in substantially coincident relation.

Also disposed within the outer container is an inner packing of unitary construction formed of corrugated fibreboard material. The inner packing includes central segment in spaced, overlying relation with the base pad whereby a substantial part of tee accommodated mower is disposed therebetween. Foldably connected to the periphery of the central segment are opposed side segments, the latter having at least portions thereof extending from the base pad to the container closure means. Each side segment includes a first portion which is disposed in recessed relation with respect to an adjacent container side section. Foldably connected to the first portion are opposed second portions, each of which spans the distance between the recessed first portion and the adjacent side section.

DESCRIPTION

For a more complete understanding of the invention, reference is made to tee drawings, wherein:

FIG. 1 is a vertical sectional view of one embodiment of the improved shipping unit with a non-riding lawn mower accommodated therein and showing the handle thereof in a collapsed mode.

FIG. 2 is a top perspective view of the shipping unit of FIG. 1 and showing the components thereof in an exploded relation.

FIG. 3 is a top view of the shipping unit of FIG. 1 showing the container closure flaps in an unfolded position.

FIG. 4 is a top plan view of the blank from which the inner packing is formed.

FIG. 5 is an enlarged fragmentary vertical sectional view of the base pad taken through a wheel well thereof and showing a mower wheel accommodated therein.

Referring now to the drawings and more particularly to FIGS. 1 and 2, an improved shipping unit 10 is shown which is particularly suitable for accommodating a relatively heavy product, such as a non-riding lawn mower L. The mower may be of either a push or self-propelled conventional rotary type with a collapsible handle H. The handle is provided with sections which are foldable relative to one another or can be disconnected from one another, when in a collapsed mode. The handle should be in a collapsed mode, when the mower L is accommodated within the unit 10.

The unit 10, as seen in FIG. 2 includes three basic components: (a) the outer container 11; (b) the base pad 12; and (c) the inner packing 13, the latter stabilizing the accommodated product.

The outer container 11 is preferably formed from a single blank, not shown, of double or single wall corrugated fibreboard material. The container 11 includes upright side and end wall panels 14 and 15, respectively which are foldably interconnected and define a rectangular area A. The shape of area A and the height of the panels 14 and 15 will depend upon the size and shape of the accommodated product. Foldably connected to the bottom edges of panels 14 and 15 are bottom closure flaps 16, which form the container bottom section when said flaps are folded into a bottom closing relation. The flaps may be retained in a bottom closing relation by staples, adhesive and/or tape.

Similar top closure flaps 17 may be foldably connected to the top edges of the panels 14 and 15. The top closure flaps 17 may be retained in a closed relation by staples, adhesive and/or tape, after the base pad 12, product L and inner packing 13 have been placed within the container 11, as will be described more fully hereinafter. It is important that the flutes of the corrugated fibreboard forming the container side and end wall panels 14 and 15 extend upright when the container is set up.

Base pad 12 is preferably formed of double wall fourply corrugated fibreboard. The peripheral shape of the pad corresponds substantially to the area A defined by the side and end panels 14 and 15 of the container. The pad rests upon and is supported by the folded bottom closure flaps 16 of the container.

Formed in the upper surface of pad 12 are a plurality of wheel wells or pockets **12*a* which are located so as to partially accommodate the wheels W incorporated in the mower L. The shape of the wells 12***a* may conform substantially to a circular sector of the accommodated wheels. Thus, the wells serve a dual function: (a) they prevent flat spotting of the wheels where the latter are provided with tires; and (b) they chock the wheels and thus, restrain lateral movement of the mower L within the container, while the unit 18 is subjected to normal handling during shipping and storage. The pad 12 may, if desired, be formed of suitable, inexpensive material other than corrugated fibreboard, for example, molded pulp, molded plastic, etc.

The inner packing 13 is preferably formed from a single blank B of single or double wall corrugated fibreboard, see FIG. 4. Blank B includes a central segment or panel 18 which, when the inner packing 13 is disposed within the container 11, is adapted to define a plane which is in vertically spaced, substantially parallel relation with the base pad 12. The spacing between the central segment and the base pad is such that the mower housing K, in which the blade and blade motor are located, can be positioned therein, as seen more clearly in FIG. 1. One end portion of the central segment is provided with a pair of spaced, parallel foldlines 18*a*, 18*b* which are spaced inwardly from an edge of the end portion. The function of the foldlines will be described more fully hereinafter.

Disposed on opposite sides of the central segment 18 and connected thereto by foldlines 20 are side segments 21, 22. In the illustrated embodiment of blank 13, the side segments 21, 22 are of like configuration and each includes a first or middle portion 21*a*, 22*a* which assumes a perpendicular upright position with respect to the central segment when the inner packing is set up and disposed within the container 11. The first portion 21*a*, 22*a* substantially spans the distance between the container end panels 15. When the inner packing 13 is accommodated within the container 11, each first portion will be vertically disposed and spaced inwardly from an adjacent container side panel 14, so that the wheels W on a given side of the mower housing K can be accommodated between the first portion and the adjacent container side panel.

Connected by foldlines 23 to opposite ends of each first portion 21*a*, 22*a* are second portions 21*b*, 22*b*. When blank B is setup to form the inner packing 13, the second portions 21*b*, 22*b* of each side segment are folded outwardly relative to the first portion and assume right angles with respect thereto, see FIG. 2. The second portions 21*b*, 22*b* span the distance between the first portion and the adjacent container side panel 14 and thus, retain the first portion in proper spaced relation with the side panel. The heights of the second portions 21*b*, 22*b* are such that they span the vertical spacing between the base pad 12 and the folded top closure flaps 17 of the container 11, see FIG. 1. The flutes of the corrugated fibreboard forming the second portions 21*b*, 22*b* should extend vertically, and thus enhance the strength of the unit against vertical compressive forces.

As seen in FIG. 2, each first portion of the side segment has an elongated center cutout 21*c*, 22*c* formed in the lower edge thereof. The cutout allows a portion of the mower housing K to extend laterally outwardly beneath the first portion. Disposed in endwise spaced relation with respect to the center cutout are notches, or open-end slots, 21*d*, 22*d* which are formed in the lower edge of the depending first portion. The notches are shaped so as to accommodate the shafts, or axles, Q for the mower wheels W.

The central segment 18 of the inner packing 13 may be provided with one, or more openings 18*c* to accommodate a filler cap for the mower fuel tank. When the mower with the collapsed handle is placed within the container, the end portion of the central segment 18 provided with the foldlines 18*a*, 18*b* is folded upwardly and inwardly so as to capture a distal portion of the collapsed handle and thus, prevent same from rattling around within the unit while the latter is being handled for shipping or storage.

Once the bottom closure flaps 16 of container 11 have been secured in a bottom section-forming relation, and the container is resting on a suitable supporting surface, the base pad 12 is positioned within the container and is supportingly engaged by the container bottom section. The mower with its handle H in a collapsed mode is then placed in the container through the open top and the mower-wheels W are positioned in the corresponding wheel wells 12*a*. In some instances, it might be preferred to position the mower onto the base pad 13 and retain the same in assembled relation therewith by tape, wire or the like before the base pad and mower are positioned within the container.

After the mower and base pad are disposed within the container, the blank B is folded so as to form inner packing 13. The packing is then lowered into the container through the open top, so that the wheel axles Q are aligned with and disposed within the corresponding notches 21*d*, 22*d* formed in the side segments of the packing 13. Simultaneously with the positioning of the wheel axles Q in the notches, lateral portions of the mower housing K will be accommodated in the center openings 21*c*, 22*c*. The center openings and the notches are of such size and configuration as to enable the remainder of the lower edges of the side segments 21, 22 to rest upon the upper surface of the base pad. As aforementioned, once the side segments are in supporting engagement with the base pad 12, the one end portion of the central segment 18, is folded about foldlines 18*a*, 18*b* so as to capture a portion of the collapsed handle. The top closure flaps 17 of the container 11 are then manually folded and secured in a closed position. Because of the vertical disposition of the inner packing side segments and the side and end panels 14 and 15, the unit 10 is possessed of high compression strength, thus, enabling a plurality of loaded units 10 to be arranged in stacked relation. The stacked units are normally positioned on a conventional pallet, not shown, so as to facilitate movement of the units by a forklift truck.

The shape and size of the components 11, 12 and 13 may vary from that shown and will depend upon the product accommodated within the unit. While the improved shipping unit has been described by way of example in relation to a non-riding lawn mower with a collapsible handle, it is not intended to be limited thereto. Thus, an improved shipping unit has been provided which is of simple, inexpensive, yet sturdy construction and can be readily assembled with a minimum amount of manual effort.

I claim:

1. A shipping unit for a product such as a non-riding mower having a collapsible handle, said unit comprising an outer container formed of corrugated fibreboard material for accommodating the mower with the handle thereof in a collapsed mode, said outer container including a bottom section, side sections extending upright from the periphery of said bottom section and adapted to embrace the accommodated mower, and closure means disposed at upper portions of said side sections for overlying the accommodated mower; a base pad disposed within said outer container and supportingly engaged by said bottom section, said base pad and bottom section being in substantially coincident relation; and an inner packing of unitary construction for engaging and stabilizing the accommodated mower, said inner packing being formed of corrugated fibreboard material, and including a central segment in spaced overlying relation with said base pad, and opposed upright side segments angularly disposed relative to said central segment and extending substantially upwardly from said base pad to said closure means when the latter is disposed in overlying relation with respect to the accommodated mower, each side segment including a first portion recessed from an adjacent side section, and second portions extending angularly from opposed peripheral segments of said first portion, each second portion spanning the distance between said first portion and the adjacent side section of said outer container.

2. The shipping unit of claim 1 wherein the first portions of said side segments are disposed in spaced substantially parallel relation to each other and to the adjacent side sections of said outer container.

3. The shipping unit of claim 1 wherein the base pad comprises a plurality of laminas of corrugated fibreboard material arranged in substantially superimposed relation.

4. The shipping unit of claim 1 wherein a surface of the base pad is adapted to supportingly engage the underside of the accommodated mower; said base pad surface being provided with a plurality of relatively spaced wheel wells in which wheels provided on the accommodated mower are adapted to be disposed.

5. The shipping unit of claim 4 wherein the first portions of the inner packing side segments have lower peripheral segments provided with open ended slots.

6. The shipping unit of claim 1 wherein opposed peripheral portions of the inner packing central segment are foldably connected to the first portions of the side segments.

7. The shipping unit of claim 1 wherein each side segment of the inner packing substantially spans the distance between a pair of opposed side sections of the outer container. each slot being adjacent a wheel well formed in said base pad and being adapted to accommodate an axle for the mower wheel disposed within the adjacent wheel well.

* * * * *

UNITED STATES PATENT AND TRADEMARK OFFICE

CERTIFICATE OF CORRECTION

PATENT NO. : 4,792,043

DATED : December 20, 1988

INVENTOR(S) : John T. Holladay

It is certified that error appears in the above-identified patent and that said Letters Patent is hereby corrected as shown below:

Col. 1, line 24, before "variety" insert --a--.

Col. 1, line 37, "therefore" should be --therefor--.

Col. 1, line 60, "tee" should be --the--.

Col. 2, line 6, "tee" should be --the--.

Col. 6, claim 5, line 15, before the period should be inserted--, each slot being adjacent a wheel well formed in said base pad and being adapted to accommodate an axle for the mower wheel disposed within the adjacent wheel well.--

Col. 6, claim 7, lines 23 through 26, delete "each slot being adjacent a wheel well formed in said base pad and being adapted to accommodate an axle for the mower wheel disposed within the adjacent wheel well."

Signed and Sealed this

First Day of August, 1989

*Attest:*

*Attesting Officer*

DONALD J. QUIGG

*Commissioner of Patents and Trademarks*